US005646658A

United States Patent [19]

Thiel et al.

[11] Patent Number: 5,646,658

[45] Date of Patent: Jul. 8, 1997

[54] MODULAR INK JET PRINTER HEAD

[75] Inventors: Wolfgang Thiel; Klaus Dietrich, both of Berlin, Germany

[73] Assignee: Francotyp-Postalia AG & Co., Birkenwerder, Germany

[21] Appl. No.: 196,545

[22] Filed: Feb. 15, 1994

[30] Foreign Application Priority Data

Mar. 16, 1993 [DE] Germany ..... 43 09 255.1

[51] Int. Cl.[6] ..... B41J 2/03

[52] U.S. Cl. ..... 347/49

[58] Field of Search ..... 347/40, 42, 49, 347/68, 71; 400/175

[56] References Cited

U.S. PATENT DOCUMENTS

| | | | |
|---|---|---|---|
| 4,393,386 | 7/1983 | Di Guilio | 347/4 |
| 4,703,333 | 10/1987 | Hubbard | 347/40 |
| 5,148,194 | 9/1992 | Asai et al. | 347/49 |
| 5,160,945 | 11/1992 | Drake | 347/42 |

FOREIGN PATENT DOCUMENTS

| | | | |
|---|---|---|---|
| 0 440 469 | 8/1991 | European Pat. Off. . | |
| 58-188661 | 11/1983 | Japan | 347/49 |
| 59-209882 | 11/1984 | Japan | 347/40 |
| 63-9549 | 11/1988 | Japan | 347/71 |
| 4-158049 | 6/1992 | Japan | 347/40 |
| 2 158 778 | 11/1985 | United Kingdom . | |
| WO 81/00151 | 1/1981 | WIPO . | |
| WO 91/04861 | 4/1991 | WIPO . | |
| WO 91/06432 | 5/1991 | WIPO . | |
| WO 91/09736 | 7/1991 | WIPO . | |

OTHER PUBLICATIONS

"Print Engine Design Utilizing Impulse Ink Jet", First Annual Ink Jet Printing Workshop, Mar. 25–27, 1992, Cambridge, Massachusetts.

Patents Abstracts of Japan, M–842 Jun. 27, 1989, vol. 13/No. 281, 1–75253.

Patents Abstracts of Japan, M–399, Jul. 24, 1985, vol.9/No. 179, 60–48368.

Patents Abstracts of Japan, M–458, Mar. 5, 1986, vol. 10, No. 55, 60–204343.

*Primary Examiner*—Benjamin R. Fuller
*Assistant Examiner*—Craig A. Hallacher
*Attorney, Agent, or Firm*—Hill, Steadman & Simpson

[57] ABSTRACT

A modular ink jet printer head has modules each having three spacers at their periphery in order to maintain a constant spacing between the modules. These spacers each have their base secured to the module and reside perpendicularly on a reference plane. The spacers of a module are brought into a detent engagement with at least those of one further, adjoining module. A base plate and two legs arranged at two first sides of the base plate form a U-shaped module carrier. Fastening elements for the modules are arranged at both second sides of the base plate and adjustment means are arranged at the legs. Offset stop edges for all modules are worked onto a side thereof parallel to one of the second sides of the base plate in the common opening of the base plates for the front edges of all modules. The reference edge of each module is brought into a detent engagement with an allocated stop edge of the base plate, so that a defined, lateral offset occurs between the modules.

22 Claims, 7 Drawing Sheets

FIG. 2c
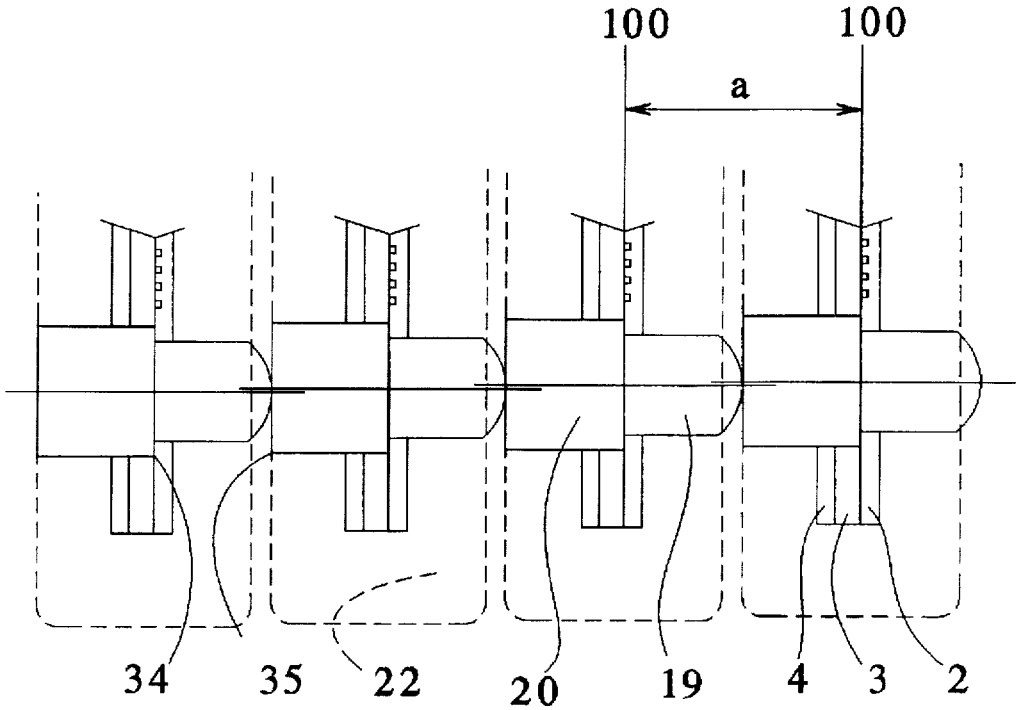
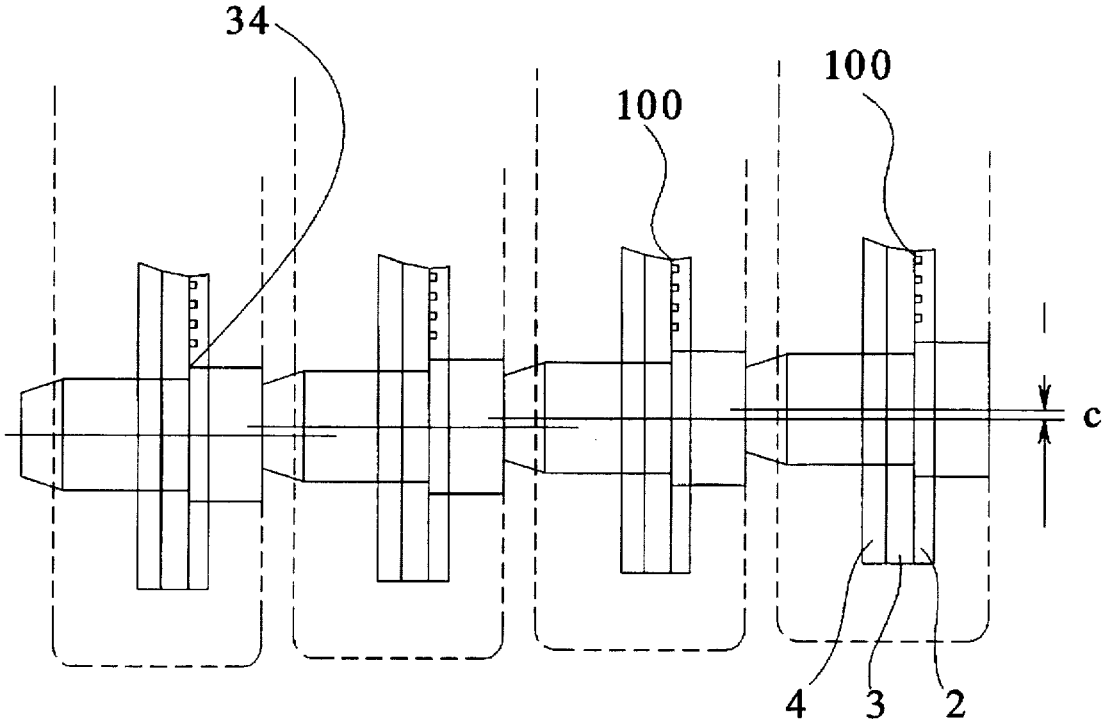
FIG. 2d

MODULAR INK JET PRINTER HEAD

BACKGROUND OF THE INVENTION

1. Field of the Invention

The present invention is directed to a modular ink jet printer head of the type having a plurality of nozzle-containing modules detachably arranged in a holder.

2. Description of the Prior Art

Ink jet printer head composed of edge-shooter ink jet modules can be utilized in many fast printers. These are employed, for example for postage meter machines for franking postal items.

It is known to detachably arrange ink jet printer head modules according to the edge-shooter principle or according to the face-shooter principle in a holder means (First Annual Ink Jet Printing Workshop, Mar. 26–27, 1992, Cambridge, Mass. The modules, however, are spaced from one another by a relatively large distance that is affected by tolerances. This is because the holder means is composed of a plate having oblong openings and two fastening means for each module, whereby the openings lie perpendicularly or obliquely above one another. The time delay of the drive pulses from module to module is therefore high and must be differently set, increased outlay in the control of the drivers. Moreover, a single module cannot be replaced without having to re-program or re-set the time delay for the control.

U.S. Pat. No. 4,703,333 discloses an ink jet printer head constructed of face-shooter modules that are releasably securable in a holder means and are arranged obliquely offset above one another. Such ink jet printer heads having an inclined arrangement of the module relative to the surface of a recording medium produce a more uniform recording even given a fluctuating thickness of the recording medium. The ink jet is no longer perpendicular to, but instead proceeds obliquely relative to, the conveying (transport) direction of the recording medium. A significant disadvantage of face-shooter printers, however, is that face-shooter printers have larger area that resides opposite the recording medium, as a result of which the spacing between the nozzle lines of the modules becomes large and only a few modules can be integrated in an ink jet printer head. This limits the recording density. This disadvantage cannot be completely eliminated either by the oblique arrangement of the modules in the conveying direction of the recording medium or by a laterally offset arrangement. The dimensions of a printer head particularly one operating with under-pressure enter directly into the printing format. The holder means has a common opening for the modules but, has a complicated shape that is correspondingly complicated to manufacture. The manufacture of the printer heads also requires a plurality of manufacturing steps given low tolerances. Guaranteeing the required precision is difficult given such a complicated overall structuring of each and every printer head. The electronic drive of these printer heads having nozzle rows offset relative to one another is likewise complicated.

German OS 32 36 297 provides pre-settable delay networks for the drive of such ink jet printer heads, laterally offset in a field, that are intended to compensate for the spacing of the ink jet printer heads along the conveying direction of the recording medium.

Such ink jet printer heads can, however, only be replaced by a skilled technician who must afterward again carry out the involved mechanical and electrical settings.

When the ink supply is based on capillary action, the ink reservoirs are arranged separated from the printer head and the ink supply pressure must lie within the range of capillary pressure, causing malfunctions to frequently occur in such ink jet printer heads. If the printer head becomes plugged, the entire printer head must be replaced.

PCT Applications WO 91/06432 and WO 91/04861 each disclose an ink jet printer head composed of a single module, which is glued on an aluminum carrier plate and is closely proximate to the ink supply system, or forms a structural unit (printer module) therewith that can be introduced into a holder. The holder has three spherical guide elements that engage in three differently shaped centering openings at one side of the printer module. A plurality of such printer modules would have to be provided for a higher printing format resolution which, however, would then lead, first, to larger dimensions of the overall arrangement and, second, to tolerance problems when introducing the printer modules, so that such printer heads are not suitable for small, lightweight postage meter printers.

U.S. Pat. No. 5,160,945 discloses an edge-shooter thermal ink jet printer head composed of individual modules that contains heating elements for ejecting the ink. Each individual module has a nozzle array and the modules are arranged at identical intervals in the x-direction, secured non-detachably on beam-shaped module carriers which are secured to flanges with pins. The modules are mounted above one another and laterally offset from one another at a spacing in the y-direction. The spacings are relatively large, since the module carriers must already have a relatively large thickness for stability reasons. Identical spacings are extremely difficult to maintain with the module carriers and flanges, particularly when many module carriers are arranged above one another. The outlay for compensating what is only a slight module nozzle density thus becomes too high and the overall structure of the printer head also becomes too large in order to be able to utilize it in postage meter machines. Additionally, the modules cannot be individually replaced.

Another edge-shooter ink jet module that has been proposed is composed of at least three glass pieces, i.e. a middle part having openings and two side parts each having a series of ink chambers. A common row of nozzles is situated at the end face of the first side part. The two rows of ink chambers and the associating nozzles are offset relative to one another, whereby all nozzles in one row lie at the end face of first side part and the ink chambers of the second side part are connected via channels in the middle part to the corresponding nozzles in the first side part, or to the ink supply. An even more highly integrated module can be manufactured according to this principle, which has only a single row of nozzles and forms an edge-shooter ink jet in-line printer head (ESIJIL printer head). A spacer layer composed of the same material as the piezoelectric elements provided for expelling the ink from the ink chambers is arranged on the outside surface of the glass part between the respective sintered blocks of three glass parts, this spacer layer joining the sintered blocks to one another in a non-detachable fashion. If the printer head is damaged during assembly or if the printer head malfunctions during later operation of the printer head, the entire printer head must then again be replaced. However, it is still difficult to achieve a high yield in the manufacture of such printer heads. Heretofore, assembly of edge-shooter ink jet modules to form an ink jet printer head having a high recording density and with low manufacturing costs without a complicated mechanical and electrical adjustment being required has not been successfully achieved, because of the manufacturing tolerances and arising in the printing format.

SUMMARY OF THE INVENTION

It is an object of the present invention to avoid the aforementioned disadvantages of the prior art in the mounting of ink jet printer heads and to create an ink jet printer head composed of modules that has a higher recording density and has lower manufacturing costs.

A further object is to provide such an ink jet printer head wherein the modules are individually detachable and can be replaced in an uncomplicated way. It should be guaranteed that only the same module type is always correctly utilized in the printer head and that no deficiencies in the printing format arise after a replacement of modules.

At least the first of the above-stated objects is achieved in accordance with the principles of the present invention in a modular ink jet printer head wherein the modules are equipped with means for drawing ink from a chamber and for ejecting ink through one or more nozzles, the modules being secured in a module carrier having an opening for the front edges of all of the modules, where the nozzles are disposed, means for fastening the modules in the holder, and spacers having a base residing perpendicularly on a reference plane of each module, the spacers of one module being brought into a detent engagement with the spacers of a further, adjoining module.

The ink jet printer head of the invention is constructed of a plurality of modules of the same type, and a flat ink jet module type composed of a plurality of module parts and spacers is utilized, allowing the spacing and the lateral offset between the replaceable modules to be precisely maintained.

For maintaining the spacing, the spacers are secured to the module with their base residing vertically on a reference plane that is formed by one surface of a module part. The spacers of one module are brought into a detent in the spacers of at least one further module.

For maintaining the lateral offset, each module has a reference edge with a high-precision spacing from the first nozzle of its nozzle line.

A base plate placed in the ink ejection direction has a common opening for the front edges of all modules. Offset detent edges for all modules are provided in the common opening of the base plate at a side parallel to one of the second sides of the base plate. The reference edges of the modules are brought into a detent with an allocated detent edge of the base plate, so that a defined, lateral offset c between the modules occurs.

In the edge-shooter ink jet module type, the reference plane is that surface of a module part which lies parallel to the plane in which the nozzle channels are fashioned.

Advantageously, all nozzle channels are provided in the inwardly disposed surface of the first module part in the edge-shooter ink jet in-line module type, i.e. the spacing between inner surface of the module part and the nozzle channel plane becomes minimal and approaches zero. Three spacers that lie at the periphery of the module and have their base secured erect on the inwardly disposed surface of the one module part that carries the nozzle channels are provided for each module.

Given employment of an edge-shooter ink jet in-line printer head (ESIJIL printer head), lower manufacturing costs and a high precision even given tolerances of the individual parts are achieved in addition to the increased nozzle density.

Proceeding on the basis of the further, above-stated object, a compactly built ink jet printer head is achieved that has a plurality of easily replaceable, identically constructed, flat modules and a U-shaped module carrier having a base plate functioning as a positioner, a holder and fastening means for the modules. The base plate disposed in the ink ejection direction again has a common opening for the front edges of all modules, making it possible to manufacture modular ink jet printer heads for a vertical arrangement of the modules relative to the surface of a recording medium.

Two legs are arranged at two first sides of the base plate. Fastening elements for the modules are arranged at the two second sides of the base plate of the module carrier and adjustment means are arranged at the legs, these interacting with the spacers lying above one another for successive modules in order to set a constant spacing of the modules following one another.

A further advantage is the possible electrical monitoring of the module type via the spacers in order to guarantee that only the same module type is always properly utilized in the printer head.

DESCRIPTION OF THE DRAWINGS

FIG. 2*c* shows a third version of spacers.

FIG. 2*d* shows a fourth version of spacers.

DESCRIPTION OF THE PREFERRED EMBODIMENTS

Figure 1A:
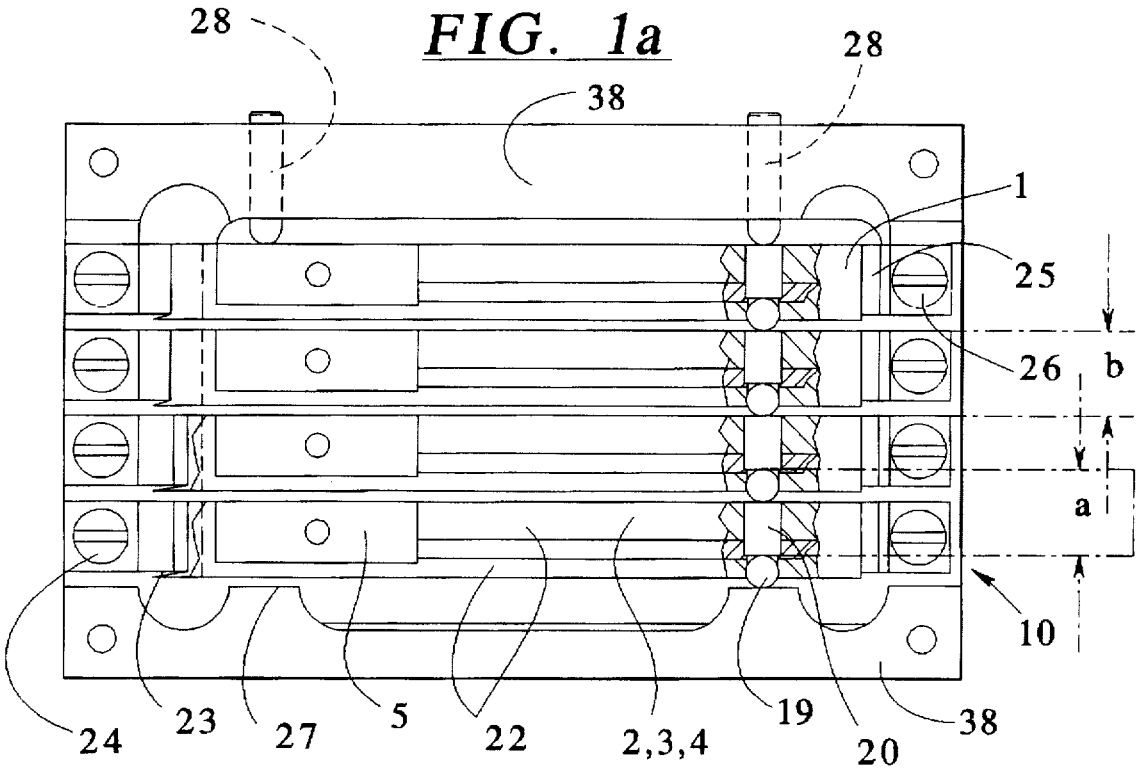
FIG. 1*a* shows the basic structure of an edge-shooter ink jet in-line (ESIJIL) printer head (ink delivery side) constructed in accordance with the principles of the present invention.

FIGS. 1*a*–1*d* show an assembled printer head having detachable modules 1 and having a U-shaped module carrier 10 as holder means. The U-shaped module carrier 10 is composed of a base plate 36 and legs 38 that are arranged at two opposite first sides at the base plate 36.

The modules 1 are shown from the back edge, i.e. from the ink delivery side. A damping block 5 is arranged at the left at the back edge and electrical drive leads—not shown in FIGS. 1*a*–1*c*—are also provided at the right at the back edge. Instead of the drive lines, the modules 1 are shown opened in FIG. 1*a* in order to show how the constant spacing is effected with spacers 19 and/or 20. These are secured to each module 1 residing vertically on a reference plane.

The structure of the ink jet printer head of the invention shall be set forth below in conjunction with an edge-shooter ink jet in-line module (ESIJIL module) composed of at least three flat ceramic or glass parts 2, 3 and 4 that are sintered together and are at least partially embedded in a protective coating 22 (synthetic encapsulation material, such as resin). Nozzles lying on a nozzle channel plane 100 are worked into the surface of only one ceramic or glass part 2, the nozzle apertures of these modules forming a line at the front side of the module part 2. When modules according to the edge-shooter principle are utilized for the ink jet printer head, the reference plane is formed by the one surface of a module part 2 or 3 that lies parallel to the nozzle channel plane 100.

In FIG. 1*a*, four identically constructed ESIJIL modules 1 are arranged in the module carrier 10 that performs a positioning, holding and fastening functions. A spacing a between the nozzle lines of the ESIJIL modules 1 is maintained with defined precision by three spacers 20 per module. The time delay of the drive pulses from module to module can thus be assumed to be constant. In the preferred version, the spacers 20 are secured to the module part that carries the nozzles, being secured thereto in the proximity of the side edges of each module 1 and thereby residing perpendicularly on the nozzle channel plane 100. The spacers 20 give the module 1 an identical thickness b=6 mm at three points; by contrast the spacing between neighboring synthetic resin surfaces of the modules can be affected with a tolerance, i.e., the actual surface-to-surface spacings can be different from each other. The spacers 20 can be secured by the synthetic resin coating.

The circular base 34 of the spacer cylinder 20 allocated to the nozzle channel plane 100 and having the larger diameter lies on the surface of the first part 2 carrying the ink chambers, namely on that surface of the part 2 in which the nozzle channels are fashioned. The other circular base 35 facing away from the nozzle channel plane 100 is in contact with the spacer of the neighboring module or with an adjustment means arranged at the closed side of the U-shaped module carrier 10. The module carrier 10 is preferably equipped with a stop face 27 (or stop screw) and with an adjustment screw 28 (and/or spring element) as the adjustment means, between which the spacers 20 are clamped. The modules 1 are detachably secured in the module carrier 10 with first fastening elements 23 and 24, and second fastening elements 25 and 26, whereby the fastening elements 23, 24, 25 and 26 are arranged at two opposite, second sides of the base plate 36. In a preferred version, the fastening elements are composed of leaf springs 23 and 25 and screws 24 and 26, and are arranged at the openly accessible second side of the U-shaped module carrier 10.

Figure 1B:
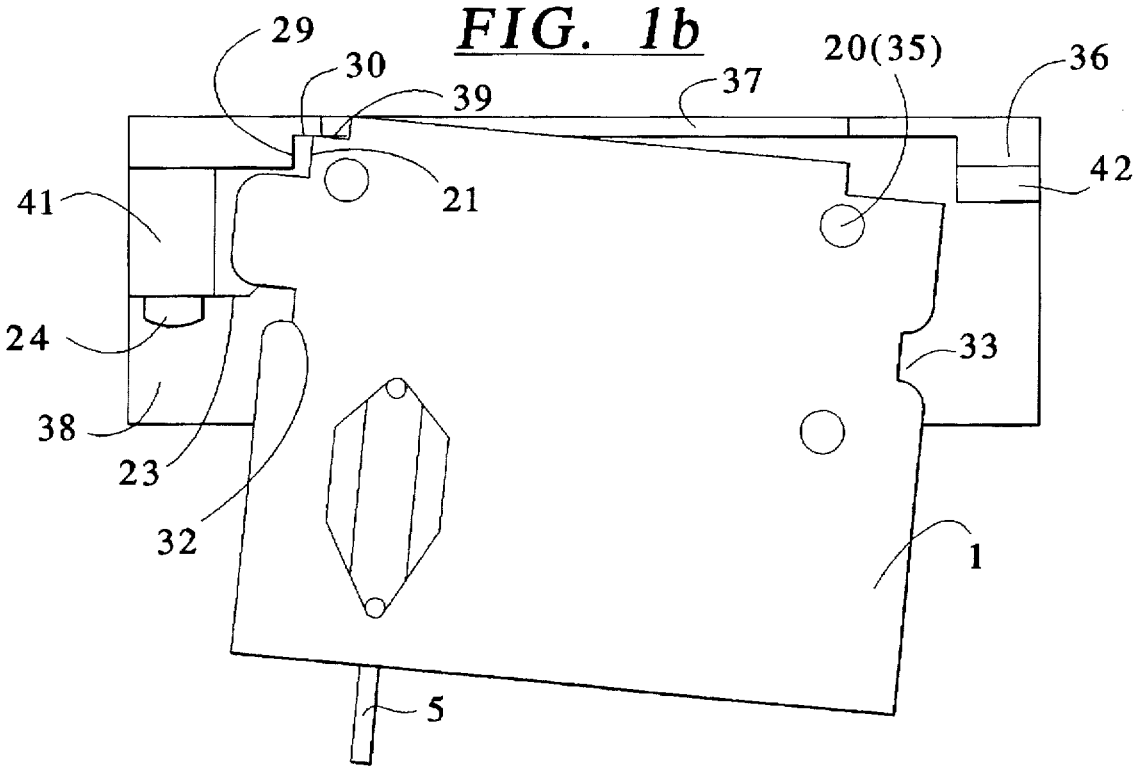
FIG. 1*b* having an ESIJIL module is snapped into the structure of FIG. 1*a*.

FIG. 1*b* illustrates the procedure of introducing a module into the module carrier 10. For the purpose of the insertion, the second fastening elements, namely leaf spring 25 and screw 26 at that side edge of the module I facing toward and closer to the electrical leads, or facing away from the damping block, have been removed, whereas the first fastening elements 23 and 24 exert a holding function during the insertion. Upon introduction, the leaf spring 23 secured to the module carrier with the screw 24 engages into the channel 32 of the side edge of the module 1 closer to and facing toward the damping block 5, or the side edge of the module 1 facing away from the electrical leads. The leaf springs 23 and 25 are spaced via spring spacers 41 and 42 that are secured to the base plate 36. The leaf springs 23 and 25 can thereby engage better in the corresponding channels 32 and 33 of each module 1. As a result, each and every module 1 can then be releasably secured in the module carrier 10.

The portion of the printer head disposed in the ink droplet ejection direction facing toward the recording medium (not shown) during printing, i.e. that part of the U-shaped module carrier facing away from the ink delivery, has an opening 37 in a base plate 36 for receiving the front edge of all modules 1 that carries the nozzle line. Offset detent edges 29 for all modules 1 are provided in the common opening 37 of the base plate 36 at a side parallel to one of the second sides of the base plate. Each module 1 has a reference edge 21 that is brought into an interactive connection with an allocated detent edge 29 of the base plate 36, so that a defined offset c occurs between the modules 1. Upon introduction of a module 1, the first reference edge 21 of the module 1 strikes against the first detent edge 29 of the base plate 36 and the second reference edge 39 of the module 1 touches the second detent edge 30 of the base plate 36.

Figure 1C:
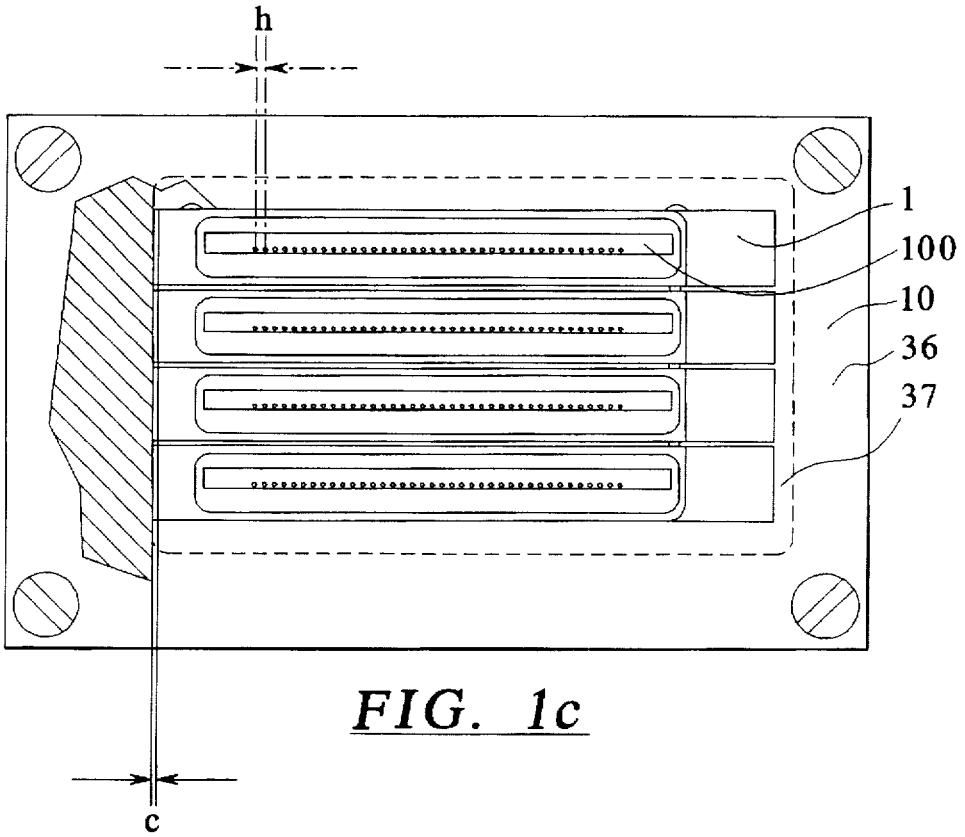
FIG. 1*c* shows the structure of an ESIJIL printer head (ink jet side) for use in the structure of FIG. 1*a*.

FIG. 1*c* shows a front view of the ink jet printer head structure of the invention. The nozzles lie in a line, since the nozzle channels are fashioned in a plane 100 on the surface of the module part 2. A required, defined offset c between the modules 1 is achieved by one offset stop edge 29 for every module 1 in the opening 37 of the base plate 36 in order to print a continuous line with high recording density with the nozzles of the four modules 1. The size of the offset corresponds to the spacing of the nozzles in the nozzle line of a module 1 divided by the plurality of modules 1. Given four modules 1 1 and a nozzle spacing of h=0.8 mm, an offset of c=0.2 mm derives.

Figure 1D:
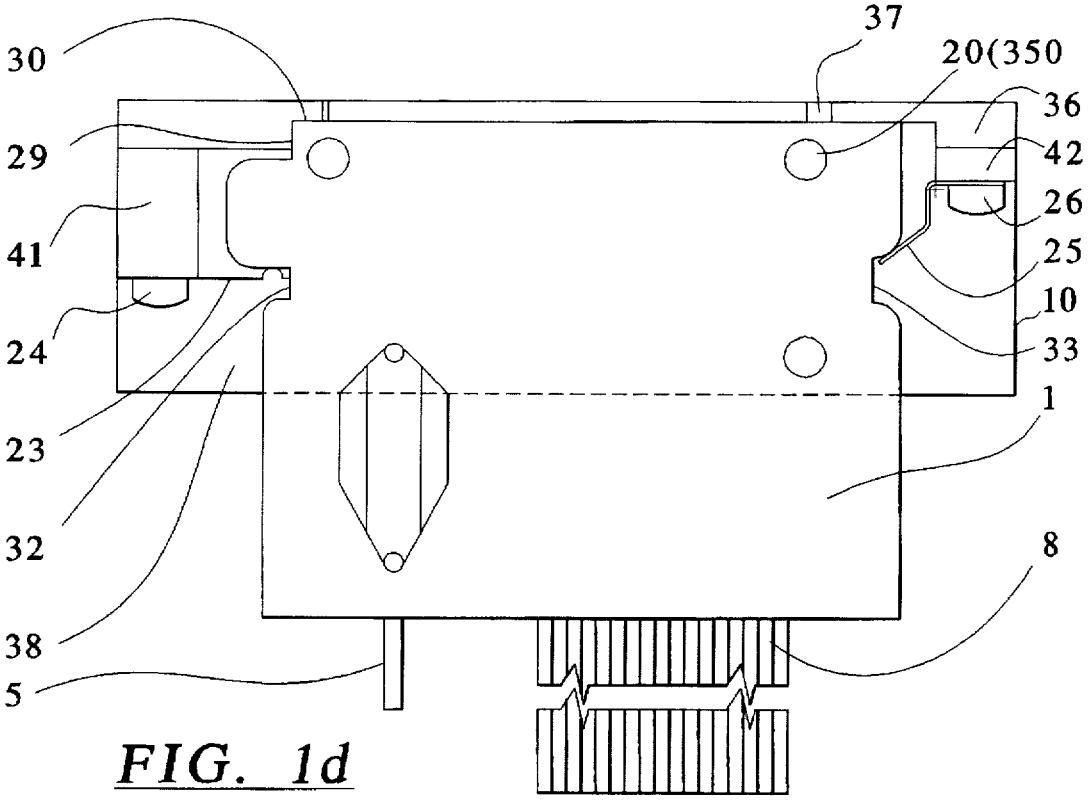
FIG. 1*d* shows the fastening an ESIJIL module in the module carrier in the structure of FIG. 1*a*.

FIG. 1*d* shows a sectional side view of the ink jet printer head structure of the invention with completely inserted and adjusted modules 1. As a result of different spring spacers 41 and 42, a respectively different, defined force is exerted onto the introduced module 1. The force of the first fastening elements 23 and 24 only causes the second reference edge 39 to be pressed against the second stop edge 30.

The second spring spacer 42 achieves a smaller spacing than the first spring spacer 41. The force exerted by the second fastening elements 25 and 26 on the introduced module 1 brought into engagement with the channel 33 of the module 1, holds its reference edges 21 and 27 pressed against the stop edges 29 and 30 in the opening 37 of the base plate 36 of the module carrier 10.

In a further embodiment, the base plate 36 can be constructed with two layers, whereby a metal plate having the common opening 37 forms the first layer and simultaneously forms the front, second stop edge 30, and whereby a further, larger common opening 40 in a second layer forms the lateral, first stop edge 29.

Corresponding to the position of the channels 32 and 33 at the lateral edges of the modules and with the intended force, the first fastening elements 23 and 24 are spaced from the base plate 36 via a first spring spacer 41 and the second fastening elements 25 and 26 are spaced from the base plate 36 via a second spring spacer 42.

In another version (not shown), the channels 32 and 33 are merely arranged at a different distance from the front edge of the module 1, whereas the spring spacers 41 and 42 have the same spacing.

In a preferred version, the first fastening elements 23 and 24, the first and second spacers 41 and 42 and the two legs 38 of the module carrier 10 can be manufactured of one piece in an injection molding process. The base plate 36 can also be composed of a shaped plastic part. In an inexpensive version, the module carrier 10 is manufactured overall of one piece in an injection molding process—except for the second fastening elements 25 and 26. The second fastening elements 25 and 26 are preferably composed of metal.

FIGS. 2a–2d show a first through fourth versions of the inventive solution for the spacers.

Figure 2A:
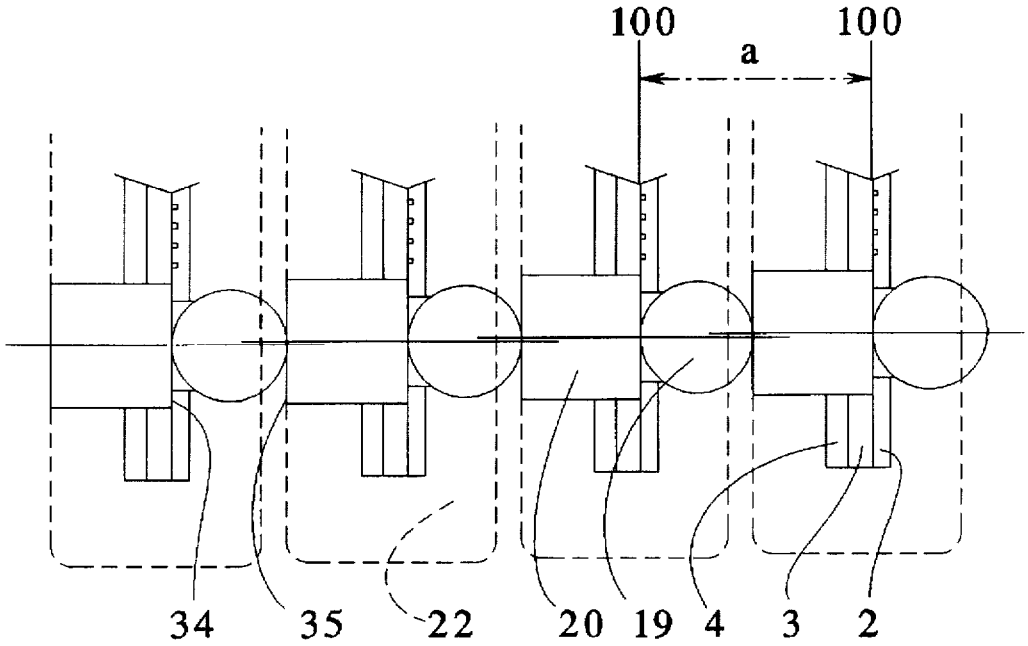
FIG. 2*a* shows a first version of spacers for an ink jet printer module constructed in accordance with the principles of the present invention.

In a first version, shown in FIG. 2a, the spacers are two-piece (two spacer members) and are each composed of a ball 19 and a spacer cylinder 20. The spacer cylinder 20 is the spacer member having the larger diameter that plugs into the openings of the second module part 4 and of the middle part 3 that are larger in diameter. A differently shaped spacer member 19 can also be utilized instead of the ball.

Figure 2B:
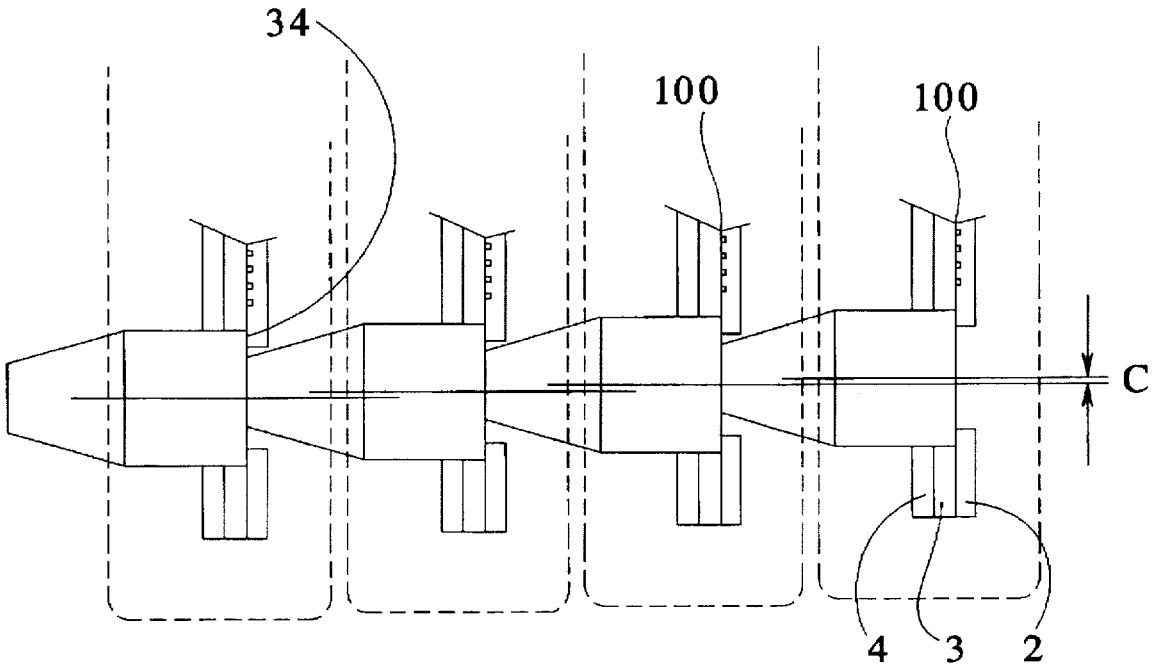
FIG. 2*b* shows a second version of spacers.

In a second version shown in FIG. 2b, the spacers 20 are fashioned of one piece as a spacer cylinder having a conical projection directed away from the nozzle channel plane 100, this projection touching the base 34 of the following spacer of the next module from the outside.

Screws (not shown) between which the spacers 20 are clamped offset behind one another by the lateral offset c are thereby provided as adjustment elements 27 and 28.

In a further version shown in FIG. 2c, similar spacer members 19 and 20 shaped as in the first version are non-detachably joined to one another to form a one-piece spacer, or can be fashioned of one piece as a spacer cylinder 20 having a conical projection 19 directed away from the nozzle channel plane 100.

In a further version shown in FIG. 2d, spacer members 19 and 20 are shaped similar to the third version and are introduced rotated by 180° are non-detachably connected to one another to form a one-piece spacer or, respectively, are fashioned of one piece as a spacer cylinder 20 having a conical projection 19. The surface of the middle part 3 lies parallel to and directly at the surface of the module part 2 in which the nozzle channels are worked. A spacer 20 introduced turned by 180° now has its base 34 residing perpendicularly on the surface of this middle part 3. Openings lying above one another are worked into the module parts 2, 3 and 4 for the spacers, whereby the opening in the first module part 2 is larger than the openings in the middle part 3 and in the second module part 4. The spacer member 19 having the smaller diameter is arranged in the openings having the smaller diameters.

In the aforementioned first, third and fourth versions, screws 28 and a stop plate 27 are provided as adjustment elements between which the spacers 20 are clamped offset behind one another by the lateral offset c.

Figure 3A:
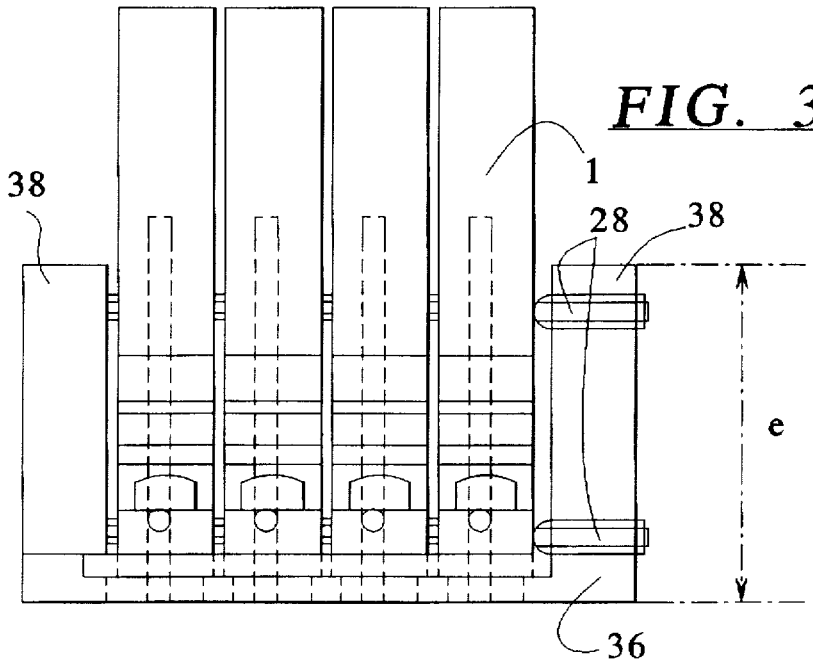
FIG. 3*a* is a side view of the U-shaped module carrier with modules constructed in accordance with the principles of the present invention introduced therein.

FIG. 3a shows a side view of the U-shaped module carrier 10 seen from the lateral edge of the modules that does not show a reference edge, thus the leads to the plug-type connector 8 lying closest to this lateral module edge are not shown. The U-shaped legs 38 of the module carrier 10 preferably have an expanse to accommodate the adjustment means and such that a lateral protection of the modules is provided at the same time. In the implemented, preferred version, a structural height of e=21 mm thus derives for the module carrier together with the U-shaped legs 38 and the thickness of the base plate 36.

Figure 3B:
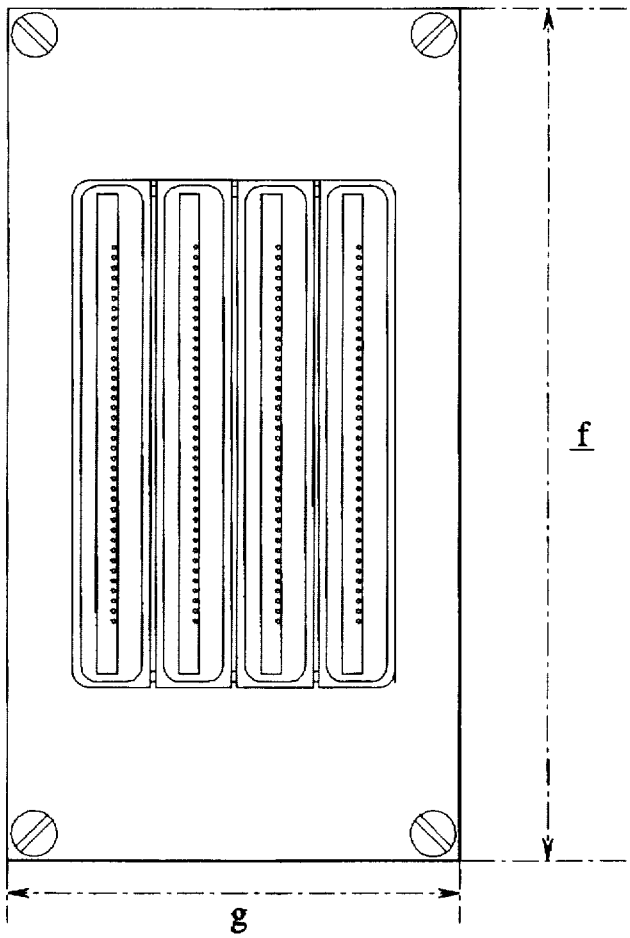
FIG. 3*b* is a front view of the base plate of the printer head of FIG. 3*a*.

FIG. 3b shows a front view of the base plate 36 having the dimensions f=66 mm and g=38 mm. The module carrier 10 is preferably manufactured of plastic.

The lateral offset of the stop edges and, thus, the offset between the nozzles of the modules I amounts, for example, to c=0.2 mm. The adjustment screw 28, the detent 27 and the spacers are manufactured of metal and can be utilized for monitoring the proper fastening of all modules or for recognizing the module type. To this end, each spacer can be respectively contacted to interconnects on the outer module surface. The spacer 20—in a way that is not shown—can be secured by soldering when the interconnects are formed by solder pads. This enables an electronic monitoring for proper seating of the modules 1 via the spacers and via an electronic monitoring circuit. If a module has defective spacers, or if a module is imprecisely introduced, a fault can be additionally recognized by the microprocessor of the postage meter machine and the result of the monitoring and can be displayed or otherwise signaled (alarm).

Figure 4:
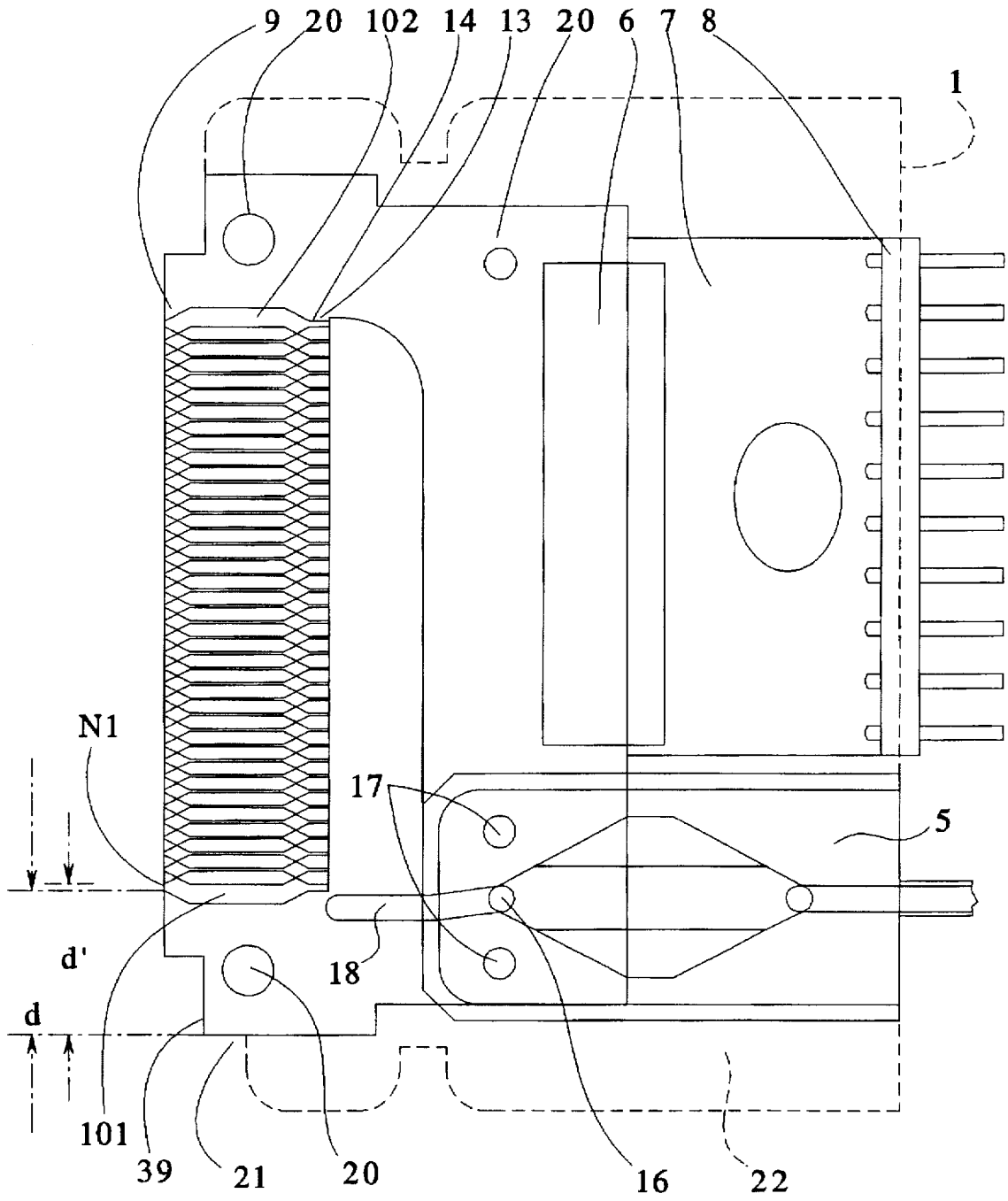
FIG. 4 shows the internal components of the inventive ESIJIL printer head module in a plan view.

The phantom view of the ESIJIL printer head module 1 of the invention shown in FIG. 4 in a plan view illustrates the lateral offset of ink chamber groups 101 of a first module part 2 containing ink chambers, and ink chamber groups 102 of a second module part 4 carrying ink chambers. FIG. 4 also illustrates a defined spacing d from a reference edge 21 to the first nozzle N1 of a nozzle group 1.1 that is allocated to the ink chamber group 101. This spacing d is achieved, for example, in that the nozzle channels and the reference edge 21 are simultaneously etched. In another version, an touching-up by fine-grinding also ensues. The nozzles of the nozzle group 1.1 alternate with the nozzles of the nozzle group 1.2 within a single nozzle row. A spacing d' to a first nozzle of the other nozzle group 1.2 can therefore likewise be defined. The spacing d or d' amounts to approximately 7 mm and can be observed with high-precision, for which reason the glass or ceramic parts have not been coated with synthetic resin at this location of the reference edge 21, and lie uncovered.

In a way that is not shown in FIG. 4, the glass or ceramic parts are each provided with a piezoelectric element 31 over every ink chamber, and electrical interconnects are also provided that are connected to a printer control (not shown) via an electrical fitting 6 having a driver primed circuit board 7 with a plug-type connector 8.

FIG. 4 also shows a first opening 18 in a middle part 3 to the ink delivery opening 16 and to the suction space 15, to the second openings 14 that are in communication with the suction space 15, and to the third openings 9 that deliver the ink to the nozzles belonging to the second nozzle group 1.2.

Each ESIJIL print head module 1 is composed of at least three parts, whereby only the first module part 2 containing a group 102 of ink chambers carries all nozzles. The suction space 15, which is located in the first module part 2, is connected to a damping block 5 via a first oblong opening 18 arranged in the middle part 3 and via an ink delivery opening 16 in the first module part 2, this damping block 5 compensating pressure fluctuations in the ink fluid that arise during operation. The middle part 3 has a plurality of second openings 14 in order to supply the ink to the chambers of a second module part 3 and has a plurality of third openings 9 in order to conduct the ink from the chambers of the second module part 3 to the corresponding nozzles in the first module part 2. Openings for the fastening element 17 of the damping block 5 and for the spacers 20 are present in all module parts 2, 3 and 4.

The module part 4 containing the second ink chambers carries no nozzles, but only the second ink chamber group 102 which is supplied with ink via the second openings 14 of the middle part 3. The associated nozzles are connected via the third openings of the middle part 3 to the ink chambers of the second part 2.

Figure 5A:
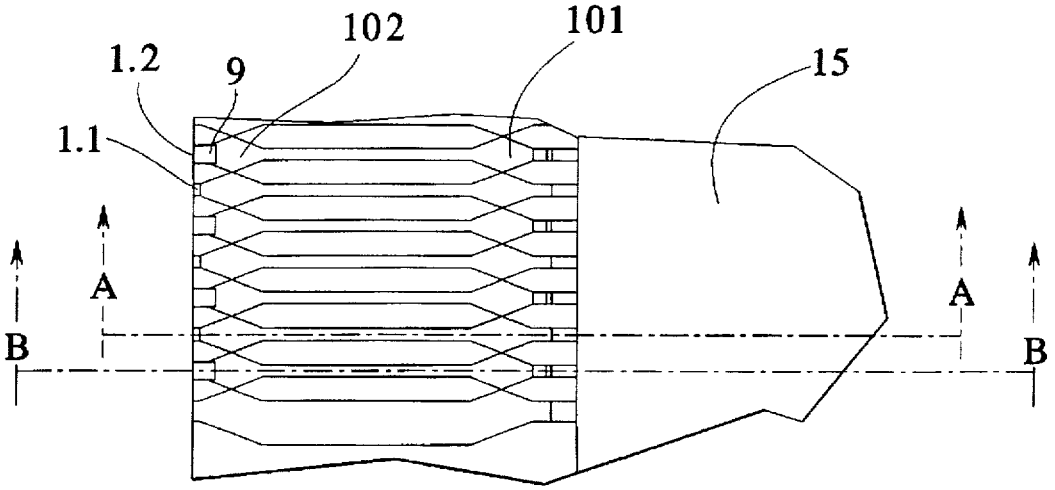
FIG. 5*a* is a detail from the view of FIG. 4.
Figure 5B:
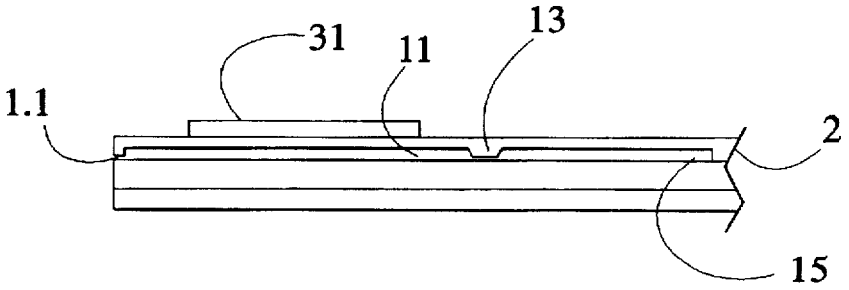
FIG. 5*b* section along the line A—A of FIG. 5*a*.

FIG. 5a shows an enlarged detail of the phantom view of FIG. 4. The ink chambers 11 of the first chamber group 101 in the first module part 2 have nozzles of the first nozzle group 1.1 in the same module part 2 allocated to them. The chamber 11 is thus supplied with ink from a suction space 15 via one of the channels 13. A corresponding section taken along line A—A through the drawing in FIG. 5a is shown in FIG. 5b.

Figure 5C:
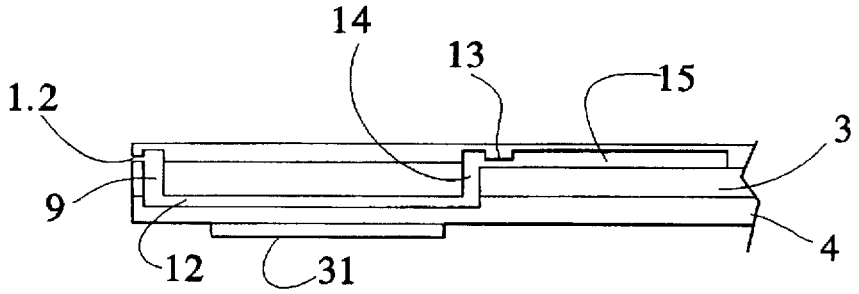
FIG. 5*c* section along the line B—B of FIG. 5*a*.

The chambers 12 of the second chamber group 102 in the second module part 4 have nozzles of the second nozzle group 1.2 in the other part 2 allocated to them, as may be seen from the section B—B shown in FIG. 5*c*. Ink proceeds from the suction space 15 in the first module part 2 into the chamber 12 of the second module part 4 via another of the channels 13 and via one of the second openings 14 in the middle part 3. A connection via a third opening 9 in the middle part 3 exists from the chamber 12 to the corresponding nozzle of the nozzle group 1.2 in the first module part 2.

The second openings 14 are present in the middle piece 3 for supplying the second nozzle group 1.2 with ink. Openings in registry with the opening 9 and 14 in the second module part 3 are provided in the module parts 2 and 3 for producing a connection of the ink chambers of the second module part 3 to the ink chambers of the second chamber group 102 and to the nozzle channels of the second nozzle group 1.2. The supply of the ink chambers 11 and 12 in the module part 3 carrying the first and second ink chamber groups ensues from the common suction space 15 in the module part 2. The ink delivery to the suction space 15 occurs via an ink delivery opening 16 in the module part 2, that forms a lateral part of the module, and via corresponding openings 18 in the middle piece and via further openings in the parts 2, 4, 6 carrying ink chambers.

For ejecting ink from a chamber, a piezoelectric element 31 (only shown in FIGS. 5*b* and 5*c*) can be arranged on the chamber surface or in the chamber, this piezoelectric element, when activated, exerting a pressure on the ink fluid in the chamber via the resilient chamber wall, leading to the ejection of an ink jet from the nozzle connected to the chamber. Such a piezoelectric element 31 (PZT crystal) is preferably arranged on the chamber surface. Thus, for example, each chamber 11 and 12 is separated from the element 31 by a thin layer 30 composed of the material of the module part 4, this being so elastic that the flexural energy of the element 31 is only insignificantly attenuated.

Although modifications and changes may be suggested by those skilled in the art, it is the intention of the inventors to embody within the patent warranted hereon all changes and modifications as reasonably and properly come within the scope of their contribution to the art.

We claim as our invention:

1. A modular ink jet printer head for use with an ink reservoir, said printer head comprising:

a plurality of modules, each module having a plurality of nozzles terminating in a front face of the module and said modules forming, in combination, means for drawing ink from said reservoir and for ejecting said ink from said nozzles in a selected pattern, each of said modules having an internal reference plane and a thickness, subject to tolerance variations from module to module, in a direction perpendicular to said internal reference plane;

a module holder having an opening for accepting said plurality of modules in a stack of successively adjacent modules;

means for detachably fastening said modules in said module holder with the respective front faces of said modules disposed in said opening; and a plurality of spacers carried by each of said modules, each spacer having a detent therein and a base end fastened perpendicularly on the internal reference plane of the module carrying the spacer, each spacer of at least one of said modules having a free end, opposite said base end, releasably engaging the detent in a spacer of another of said modules and each spacer having a length between said base end and said free end and a diameter which is non-uniform along said length for stacking said modules with a predetermined spacing between the respective pluralities of nozzles in adjacent modules independently of said tolerance variations.

2. A modular ink jet printer head as claimed in claim 1 wherein each of said spacers consists of a single spacer element.

3. A modular ink jet printer head as claimed in claim 1 wherein each of said spacers consists of a plurality of spacer members.

4. A modular ink jet printer head as claimed in claim 1 wherein each of said modules comprises an edge-shooter module having said nozzles arranged in a nozzle line at said front edge of the module, and each module having a lateral reference edge, said module holder having a base plate with a stop edge having a plurality of base plate detents therein, the respective lateral reference edges of said modules engaging said base plate detents so that a defined, lateral offset exists between adjoining modules, and wherein each module carries three of said spacers arranged proximate to the lateral edge of the module in respective openings in said module, and wherein the internal reference plane of each module is formed by a single surface of said module extending inwardly into said module holder, and each module further comprising a plurality of nozzle channels, respectively in fluid communication with the nozzles of the module, said nozzle channels being disposed in a nozzle channel plane disposed parallel to, and at a defined spacing from, said inwardly extending surface of the module.

5. A modular ink jet printer head as claimed in claim 4 wherein one of said modules is disposed adjacent said base of said module holder, and wherein the spacers carried by said one of said modules press against said base.

6. A modular ink jet printer head wherein as claimed in claim 1 said spacers have a diameter which increases along a length of the spacer with said spacer having a largest diameter at a side thereof adjacent the module which carries the spacer, and wherein said spacers are attached to the module carrying the spacers by embedding the spacers in a synthetic encapsulation material on the module.

7. A modular ink jet printer head as claimed in claim 1 wherein said spacers have a diameter which increases along a length thereof, said spacers having a largest diameter at an end of the spacer adjacent the module carrying the spacer, each of said modules having a plurality of solder pads thereon, and wherein said spacers are attached to the module carrying the spacers by soldering the spacers respectively to said solder pads.

8. A modular ink jet printer head as claimed in claim 1 wherein each spacer has a diameter increasing along a length thereof and having a largest diameter at a side of the spacer adjacent the module carrying the spacer, and wherein each of said modules has a plurality of first openings therein in registry with a plurality of second openings in an adjoining module, said first openings having a larger diameter than said second openings, and wherein the side of each spacer having said largest diameter is received in one of the first opening in the module carrying the spacer, and wherein an opposite end of the spacer is received in the second opening in the adjoining module.

9. A modular ink jet printer head as claimed in claim 1 wherein each of said spacers consists of electrically conductive material and wherein each of said modules includes a part of an electrical circuit which is closed when said spacer is properly seated between two adjoining modules, and said modular ink jet printer head further comprising means for monitoring the closure of each of said complete circuits for identifying any improper seating of said spacers.

10. A modular ink jet printer head as claimed in claim 9 wherein said module holder includes adjustment means, extending between at least one of said modules and said holder, for maintaining the spacers of the respective modules tightly pressed against an adjoining module, said adjustment means consisting of electrically conductive material and said complete circuit including said adjustment means.

11. A modular ink jet printer head as claimed in claim 1 wherein said module holder includes adjustment means, extending between at least one of said modules and said holder, for maintaining the spacers of the respective modules tightly pressed against an adjoining module.

12. A modular ink jet printer head as claimed in claim 11 wherein said module holder comprises a U-shaped module carrier having a base plate with respective legs at opposite sides of said base plate, said adjustment means extending from said legs to respectively engage modules adjacent said legs.

13. A modular ink jet printer head as claimed in claim 12 wherein each of said modules has lateral edges with channels respectively disposed in said lateral edges, and further comprising a plurality of fastening means for fastening said modules in said module carrier, each fastening means comprising a spring detachably secured to said base plate with a screw, said springs respectively engaging said channels in said lateral edges of each of said modules.

14. A modular ink jet printer head as claimed in claim 13 wherein the respective channels in the lateral edges of each module are disposed at respectively different first and second distances from said front edge of the module.

15. A modular ink jet printer head as claimed in claim 14 wherein said fastening means include a first set of fastening means spaced from said base plate by a first spring spacer for engaging said lateral edges of said modules at said first distance from said front edge, and a second set of fastening means spaced from said base plate by a second spring spacer for engaging said channels in said lateral edges at said second distance from said front edge.

16. A modular ink jet printer head as claimed in claim 13 wherein each of said spacers consists of a ball and a spacer cylinder adjacent said ball.

17. A modular ink jet printer head as claimed in claim 11 wherein each adjustment means comprises two screws.

18. A modular ink jet printer head as claimed in claim 11 wherein each adjustment means comprises a screw and a stop face in said module carrier.

19. A modular ink jet printer head as claimed in claim 11 wherein each of said adjustment means comprises a spring element and a stop face in said module carrier.

20. A modular ink jet printer head as claimed in claim 1 wherein each of said spacers consists of a ball and a spacer cylinder adjacent said ball.

21. A modular ink jet printer head as claimed in claim 1 comprising four of said modules.

22. A modular ink print head as claimed in claim 1 wherein, in each module, said plurality of nozzles is disposed in a nozzle plane, and wherein said internal reference plane and said nozzle plane are co-planar.

* * * * *